United States Patent [19]

Ghosh

[11] 4,352,280

[45] Oct. 5, 1982

[54] COMPRESSION FORMING OF SHEET MATERIAL

[75] Inventor: Amit K. Ghosh, Westlake Village, Calif.

[73] Assignee: Rockwell International Corporation, El Segundo, Calif.

[21] Appl. No.: 150,472

[22] Filed: May 16, 1980

[51] Int. Cl.[3] ..... B21B 9/00

[52] U.S. Cl. ..... 72/38; 72/60; 72/342; 72/364

[58] Field of Search ..... 72/60, 364, 342, 38, 72/20, DIG. 4

[56] References Cited

U.S. PATENT DOCUMENTS

| | | | |
|---|---|---|---|
| 3,340,101 | 9/1967 | Fields, Jr. et al. | 72/364 X |
| 3,516,274 | 6/1970 | Graham et al. | 72/57 |
| 3,920,175 | 11/1975 | Hamilton et al. | 228/173 |
| 3,927,817 | 12/1975 | Hamilton et al. | 228/157 |
| 3,974,673 | 8/1976 | Fosness et al. | 72/364 |
| 4,087,037 | 5/1978 | Schier | 228/157 |
| 4,197,977 | 4/1980 | Deminet | 228/157 |
| 4,233,829 | 11/1980 | Hamilton | 72/342 X |
| 4,233,831 | 11/1980 | Hamilton et al. | 72/60 |
| 4,266,416 | 5/1981 | Festag et al. | 72/60 |

*Primary Examiner*—Leon Gilden

*Attorney, Agent, or Firm*—H. Fredrick Hamann; Craig O. Malin

[57] ABSTRACT

A sheet of material is held in a die opposite a forming surface of the die, and gas pressure is applied to both sides of the sheet. The pressure creates a compressive stress in the sheet thickness direction sufficient to cause plastic flow. By maintaining the pressure higher on the side of the sheet opposite to the forming surface, the sheet bends and expands toward the die forming surface. This pressure differential can be increased as necessary to bend the sheet into the crevices which make up the details of the forming surface. The sheet may be heated during forming to lower the compressive stress which is required to cause it to flow plastically.

12 Claims, 7 Drawing Figures

COMPRESSION FORMING OF SHEET MATERIAL

BACKGROUND OF THE INVENTION

1. Field of the Invention

This invention relates to the field of material forming and particularly to the forming of sheet material.

2. Description of the Prior Art

The forming of sheets of metal and plastic into parts is a highly developed art. Numerous processes such as press bending, multiple slide forming, drawing, coining, spinning, roll forming, explosive forming, electromagnetic forming, and rubber pad forming have been developed for forming sheet metals as described in the American Society for Metals *Handbook, Volume* 4, *Forming.*

More recently, sheet metals have been formed under conditions which take advantage of their superplastic properties. As described in U.S. Pat. No. 3,340,101 to D. S. Fields, Jr. et al., superplastic forming is a process in which metals can be stretched into a die in a manner resembling the basic thermoforming process employed in the polymer and glass forming industries.

Except for coining and shear spinning, these prior art processes utilize predominately tensile stresses in the plane of the sheet to cause the plastic deformation of the material being formed. For example, in superplastic forming of metals or in blow forming of plastics, a gas pressure is applied to one side of the sheet of material being formed. This pressure stretches the material into a die cavity as a result of the tensile stresses created in the plane of the sheet.

Forming of sheet materials by prior art tensile forming methods is limited by tensile instability and fracture, which may occur following overall elongations of no more than 50 to 60%. Although much higher elongations can be obtained under superplastic forming conditions, the forming rates are extremely slow, requiring several hours for superplastic forming. Additionally, thickness nonuniformities develop during superplastic forming and thus produce parts having greater thickness tolerances.

SUMMARY OF THE INVENTION

It is an object of the invention to provide a method for forming sheet material into parts in which compressive stresses in the through thickness direction of the sheet rather than tensile stresses in the plane of the sheet provide the dominant forming force.

It is an object of the invention to provide a method for forming sheet material into parts without causing excessive tensile necking or fracture of the material.

It is an object of the invention to provide a method for forming sheet material into parts at forming rates which are faster than the forming rates obtainable using prior art superplastic forming methods.

It is an object of the invention to provide a method for forming sheet material into parts which require large deformation of the material.

According to the invention, a sheet of plastic material such as a metal or an organic polymer is held in a die opposite a forming surface of the die. A fluid pressure, generally gas pressure, is then applied to both sides of the sheet to create a compressive stress in the sheet which at least equals the stress at which the material begins to flow plastically. This pressure tends to thin the sheet and causes it to expand in the plane of the sheet in order to maintain a constant volume of material in the sheet.

The pressure on the side of the sheet which faces away from the forming surface of the die is maintained higher than the pressure between the sheet and forming surface. This pressure differential causes the expanding sheet to bend toward the die and to form against its surface. The pressure differential can be increased as necessary to bend or form the metal into the crevices and radii which make up the details of the forming surface.

In order to lower the compressive stresses which are required to cause plastic flow of the material, the sheet may be heated. Additionally, the temperature and forming rate can be selected to form the material under superplastic conditions.

These and other objects and features of the invention will be apparent from the following detailed description, taken with reference to the accompanying drawings.

DESCRIPTION OF THE PREFERRED EMBODIMENT

In order to form a sheet of plastic material into a part, it is necessary to increase the surface area of the flat steel so that it conforms to the greater surface area of the shaped part. This is normally accomplished by applying forces on one side of the sheet in order to stretch the material into a die. However, in the present invention pressure is applied to both sides of the sheet, thus increasing the area of the sheet by squeezing it from both sides. A slight pressure differential is maintained so that the sheet is positioned against the surface of the die as it spreads under the influence of the compressive stress. This pressure differential does induce some tensile stresses in the plane of the sheet as it bends the sheet into the depressions in the die cavity. However, these tensile stresses are not sufficient to form the sheet without the through thickness compressive stress which accomplishes the major plastic deformation by expanding the area of the sheet. Under these compressive conditions tensile necking and microcracking are minimized and extensive plastic deformation is possible.

Nearly equal pressure is maintained initially on both sides while increasing the pressure level to a constant value depending upon the desired forming rate. This pressure needs to be equal to or greater than the flow stress of the material at the desired strain rate. Flow stress is defined as the stress required to cause plastic deformation of a material. At ambient temperature the flow stress of most structural materials is too high to be of practical interest in compression forming because very high gas pressures are required. However, the temperature of the material can be raised in order to reduce its flow stress to a level suitable for compression forming. At high temperatures flow stresses are reduced significantly and practical forming rates can be achieved using reasonable gas pressures. The flow stress for a particular material at various temperatures can be determined using standard high temperature tensile testing techniques.

Since exactly equal pressure on both sides of the sheet will prevent the sheet from forming (or buckling), a pressure differential is maintained to cause the sheet to blow into the die cavity as its surface area is increased by the thinning action of the pressure. As long as the pressure differential is near zero, the initial pressurization rate may be extremely fast and yet, it will not adversely affect the uniformity of thinning of the material. Once the desired pressure corresponding to a high thinning rate is achieved, the pressure differential may be increased.

Figure 1:
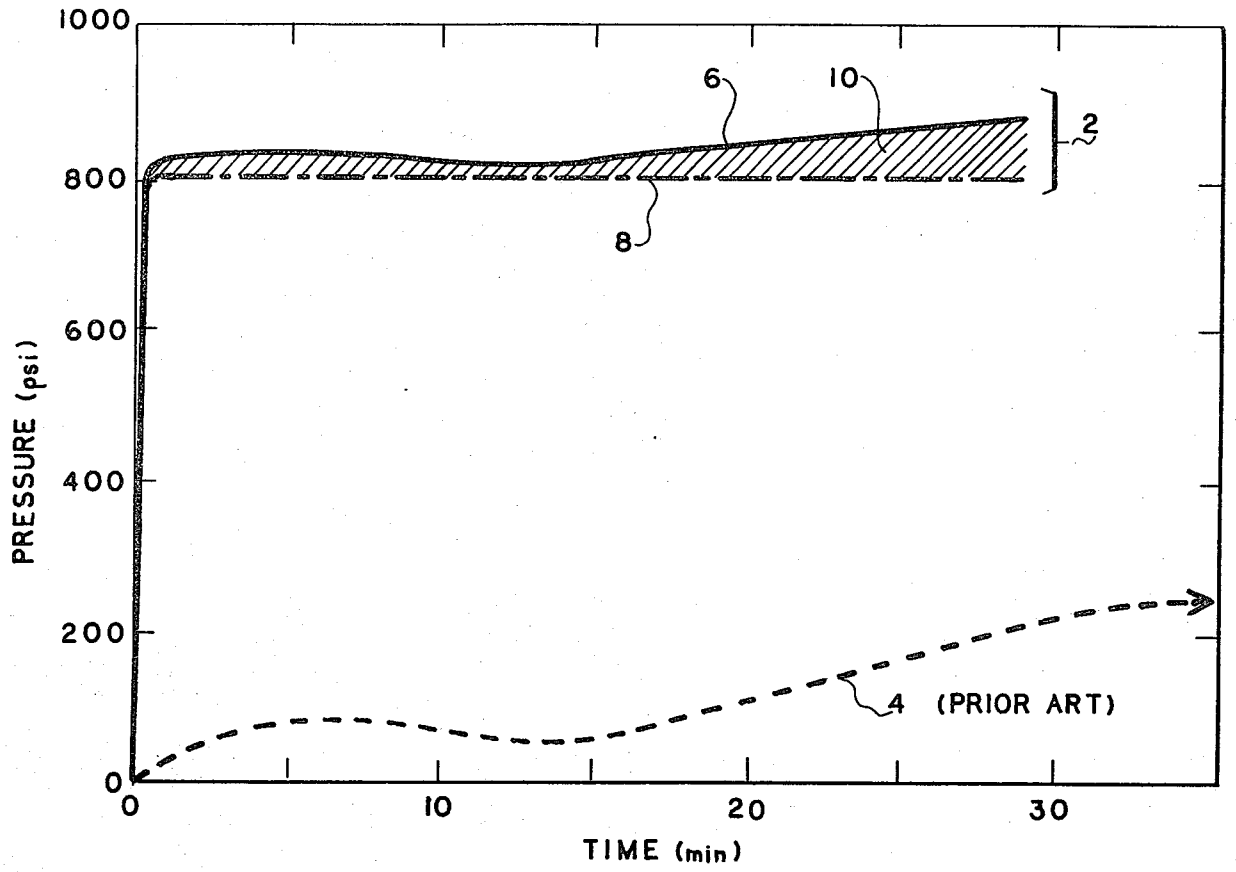
FIG. 1 is a graph of pressure vs time for prior art superplastic forming and for compression forming of an aluminum alloy into a channel.

An example of a pressure and time relationship is shown in FIG. 1 for compression forming according to the present invention, curve 2, and for a current prior art superplastic forming method such as taught in U.S. Pat. No. 4,181,000, curve 4. The material being formed is aluminum alloy 7475 and the forming temperature is 515° C. As shown in curve 2, forward pressure 6 and back pressure 8 are both raised rapidly to 800 psi. At this pressure and temperature, the aluminum alloy will flow plastically. Forward pressure 6 is increased slightly above back pressure 8 to create differential pressure 10 (shaded area). Under these conditions, forming of a rectangular box or channel section is completed in about 30 minutes. Under prior art superplastic forming conditions (curve 4), the same box requires about 80 minutes to form.

Pressure differential 10 generates a tensile stress in the plane of the sheet which, in the case of a plane strain channel (e.g., on a long cylindrical or box section), is given by:

$$\sigma_1=\delta\rho/t,$$

where:

$\sigma_1$=the maximum principal stress in the plane of the sheet, $\delta$=the pressure differential, $\rho$=radius of the unsupported part of the sheet, and t=the sheet thickness.

Since through-thickness stress, $\sigma_3=-(p+\delta/2)$, the effective stress causing plastic flow increases because of the differential. In the case of a plane strain channel, Levy-Mises relations give:

$$\dot{\epsilon}_2=\dot{\lambda}(\sigma_2-(\sigma_1+\sigma_3)/2)=0,$$

where:

$\sigma_3$=the stress in the through-thickness direction, p=the back pressure, $\dot{\epsilon}_2$=the transverse strain rate, $\dot{\lambda}$=the plastic modulus rate.

Thus, $\sigma_2=((\sigma_1+\sigma_3)/2)$.

When the above values of $\sigma_1$, $\sigma_2$, and $\sigma_3$ are used in Von Mises effective stress equation, we obtain:

$$\sigma_e=\frac{\sqrt{3}}{2}\left\{p+\delta\left(\tfrac{1}{2}+\frac{\rho}{t}\right)\right\}.$$

Since in prior art one-sided pressure forming:

$$\sigma_e=\frac{\sqrt{3}}{2}\sigma_1,$$

where $\sigma_1$=maximum principal membrane stress, the effective stress ratio in the two processes, f, is given by:

$$f=\frac{\sigma_e\text{ (compression)}}{\sigma_e\text{ (prior art)}}=\frac{p}{\sigma_1}+\left(\frac{\delta}{\sigma_1}\right)\left(\tfrac{1}{2}+\frac{\rho}{t}\right).$$

If p in compression forming is selected as $\sigma_1$ in conventional forming, then:

$$f=1+(\delta/\sigma_1)(\tfrac{1}{2}+\rho/t)$$

which is greater than 1. Thus, effective strain rates greater than those in prior art methods are possible. Since at the start of the forming cycle $\rho/t>>1$, f can be significantly greater than 1, unless $\delta$ is near zero. It appears that the pressure differential, $\delta$, should be controlled to remain small initially to prevent an excessively high thinning rate, however it can be increased later as the radius, $\rho$, decreases during forming.

Some pressure differential, $\delta$, is required to bend the sheet into the die cavity. From the consideration of the bending moment to elastically bend the sheet so that a desired depth may be obtained, the differential pressure should be:

$$\delta=Et^3h/4W^4$$

where:

E=the elastic modulus, h=the depth from elastic bending, and

W=the die width.

Calculations show that $\delta$ should be increased with depth, and that it should be significantly high in order to conform the sheet to small die bottom radii. However, plastic bending and shape fixing is possible at pressures much lower than those predicted by the above equation for elastic bending.

Figure 2:
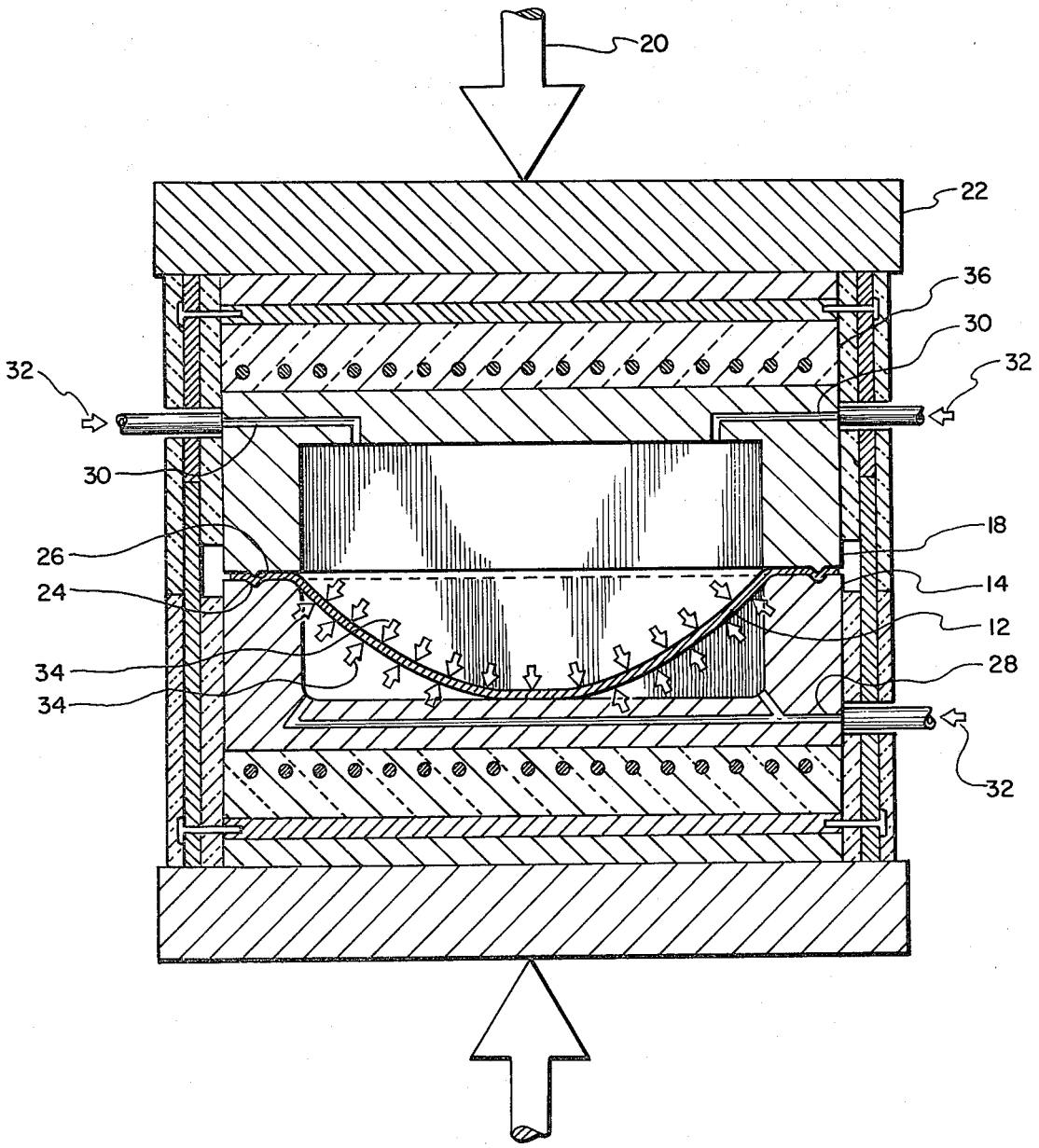
FIG. 2 is a cross section of a die and heater assembly between the platens of a press during compression forming of a channel section.

FIG. 2 is a cross section of a die and heater assembly used to form a sheet 12 of metal into a U-shaped channel. In this illustration, sheet 12 is in the process of being formed into a channel and has been formed downward until it is touching the bottom of lower die portion 14 of the die assembly. Sheet 12 is held in the die assembly by clamping its periphery between upper die portion 18 and lower die portion 14. A clamping pressure 20 is supplied by placing die assembly 16 between the platens 22 of a press. A groove 24 and a matching protrusion 26 form a seal between the inside and the outside of the die assembly.

Important features of the die are gas passages 28 in lower die portion 14 and gas passages 30 in upper die portion 18. Gas 32 under controlled pressure is admitted into lower and upper die portions 14, 18 through passages 28, 30. This pressurized gas creates a through-thickness compressive stress in sheet 12 as illustrated by arrows 34. If the pressure in upper die portion 18 is maintained higher than the pressure in lower die portion 14, then sheet 12 will bend downward as it expands under compressive stress 34. Gas passages 28 are located in the corners of the forming die in order to allow an exit for the gas as sheet 12 is formed against the die surface.

Heaters 36 are held against lower and upper die portions 14, 18 to heat sheet 12 to a predetermined forming temperature and thereby reduce the required pressure as previously discussed. Supporting and insulating plates are provided to hold the heaters against the die and to confine the heat to the die. Depending upon the pressures used, load carrying members can extend from the platens to the dies to reduce the stress on the heaters.

Figure 3:
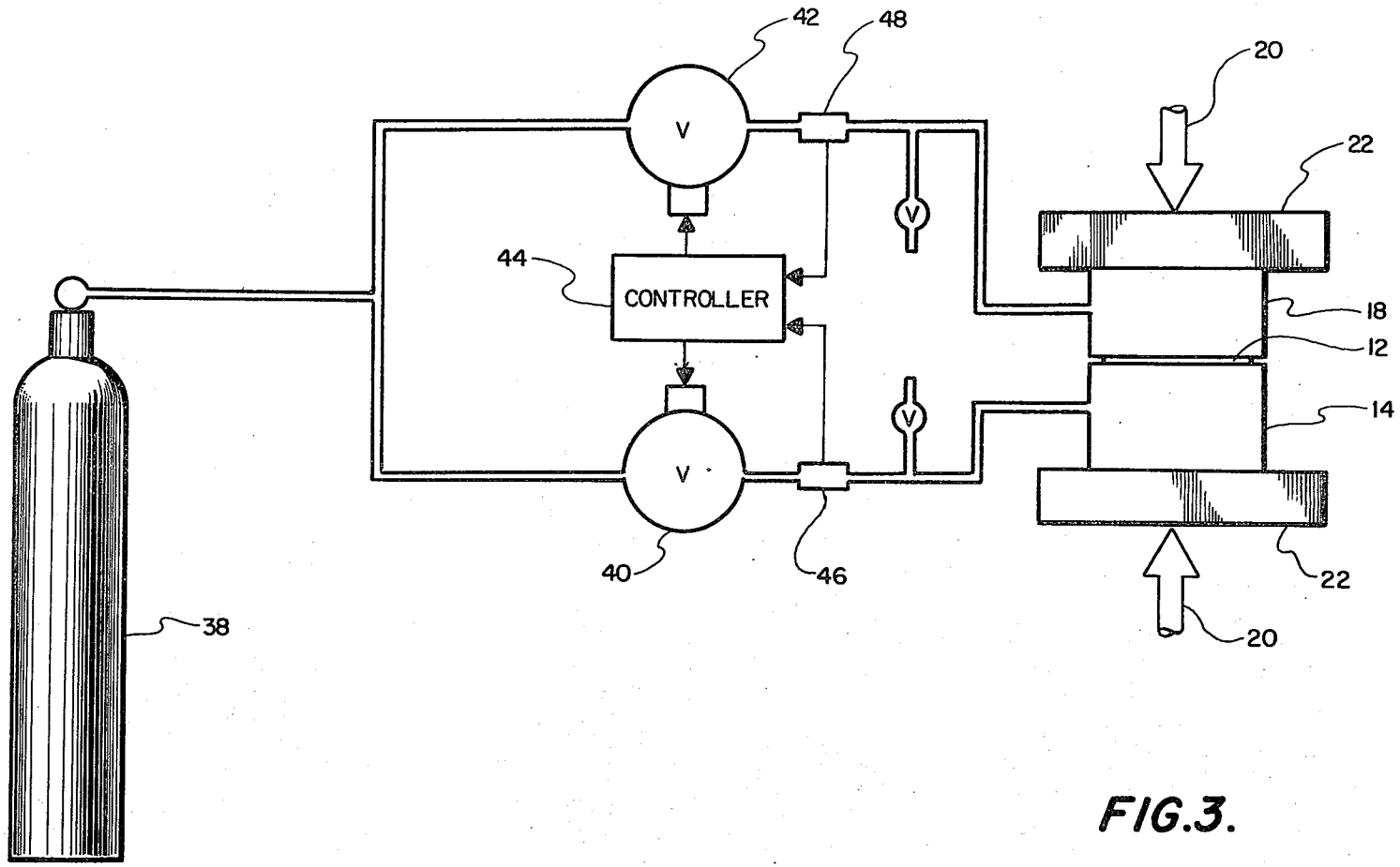
FIG. 3 is a schematic showing a system for controlling the gas pressure to both portions of a die.

FIG. 3 is a schematic showing a system for controlling the gas pressure to both portions of the die and for maintaining the pressure higher in one portion of the die than in the other portion. Portions 14, 18 of the die are connected to a source 38 of high pressure gas through separate motor operated pressure control valves 40, 42. A controller 44 is programmed to provide separate control outputs for valves 40, 42 such as the forward and back pressure vs time curves 6, 8 shown in FIG. 1. Feedback to controller 44 is provided by pressure transducers 46, 48. Vent valves 50, 52 are provided to vent the lines and die portions as required during forming and after forming. These valves may also be controlled by controller 44.

Figure 4:
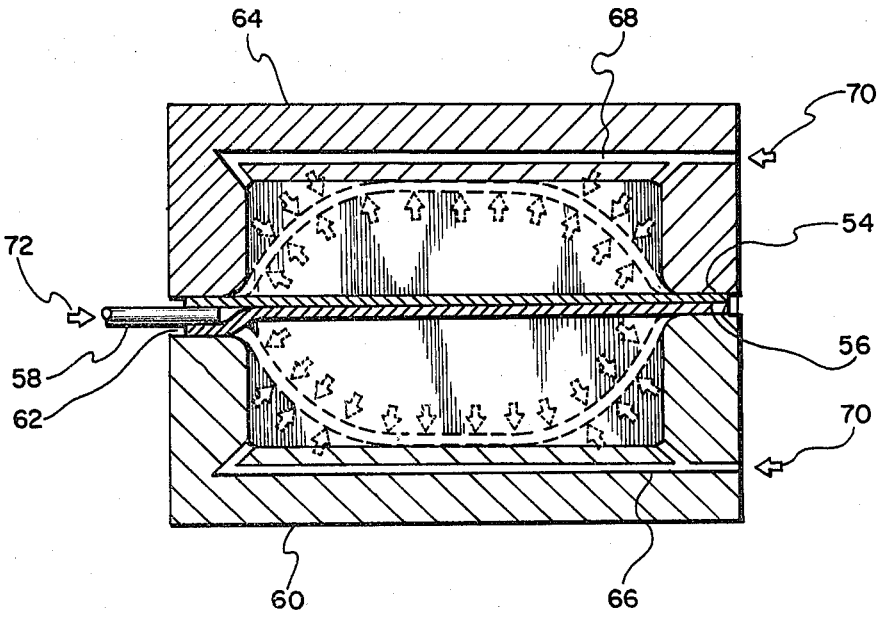
FIG. 4 is a cross section of a die used to compression form a two layer structure.
Figure 5:
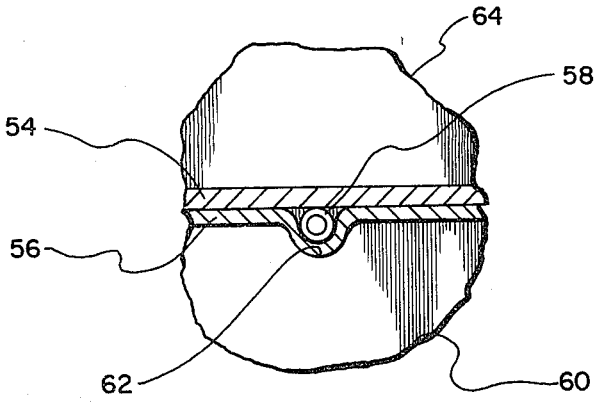
FIG. 5 is a view showing the tube inlet into the die shown in FIG. 5.

In a second embodiment of the invention, compression forming is used to make multilayer structures such as shown in U.S. Pat. Nos. 3,920,175 and 3,927,817. Two sheets 54, 56 are bonded around their periphery except for one location where tube 58 is brazed or otherwise sealed between the sheets, and placed in a die for forming a two layer structure as shown in FIG. 4. Lower die portion 60 has a groove 62 to accommodate tube 58 (also see FIG. 5). Gas 72 is passed through tube 58 to provide a forward pressure against the adjacent surfaces of the sheets and separate them into their respective die cavities. Both lower and upper die portions 60, 64 have forming surfaces and passages 66, 68 to admit gas 70 into the die cavities so that a back pressure can be maintained on the surfaces of the sheets which face the die forming surfaces. This back pressure provides the through thickness compressive stress on both sheets 54, 56. As discussed for the single sheet embodiment, the back pressure is held at a pressure high enough to cause plastic deformation, while the forward pressure is maintained higher than the back pressure so that the sheets are formed against the die surfaces, as shown by the dashed lines in FIG. 4.

Examples of the method of the invention used to form a 2 inch×6 inch×1 inch deep rectangular box are given below. Samples were formed from 0.040 inch through 0.080 inch thick sheets. Depending upon the material being formed and the pressures available, the invention is suitable for forming a wide range of sheet thickness.

EXAMPLE I

A sheet of 7475 aluminum alloy was placed between upper and lower die portions such as shown in FIG. 2. The die and aluminum alloy was heated to 515° C. and pressure was raised equally and simultaneously in both portions of the die to 800 psi. Then a constant positive differential of 20–30 psi was set up in the upper die portion, the bottom die being the shaping die. After 30 minutes the rectangular box was formed approximately 80%. It is estimated that an additional 10 minutes would have completed forming of the box. Thinning of the material appeared to be fairly uniform.

EXAMPLE II

A sheet of 2124 aluminum alloy was placed in a die and processed as described in Example I except that a temperature of 490° C. and a back pressure of 555 psi were used. After 30 minutes the rectangular box was formed approximately 80%. It is estimated that an additional 10 minutes would have completed forming of the box. Thinning of the material appeared to be fairly uniform.

EXAMPLE III

A sheet of 8050 aluminum alloy was placed in a die and processed as described in Example I except that a temperature of 555° C. and a back pressure of 680 psi were used. After 4 minutes the rectangular box was completely formed, and thinning of the material appeared to be fairly uniform.

EXAMPLE IV

A titanium alloy, 6A14V, can be formed by placing it in a die and processing it as described above for the aluminum alloys except that higher temperatures and pressures are required because of titanium's higher flow stress. A rectangular box can be formed at a temperature of 925° C., a back pressure of approximately 1800 psi and a forward pressure which is maintained at about 115 psi higher than the back pressure for the first 4 or 5 minutes and is then gradually increased to about 460 psi after 9 or 10 minutes when forming is complete.

Figure 6:
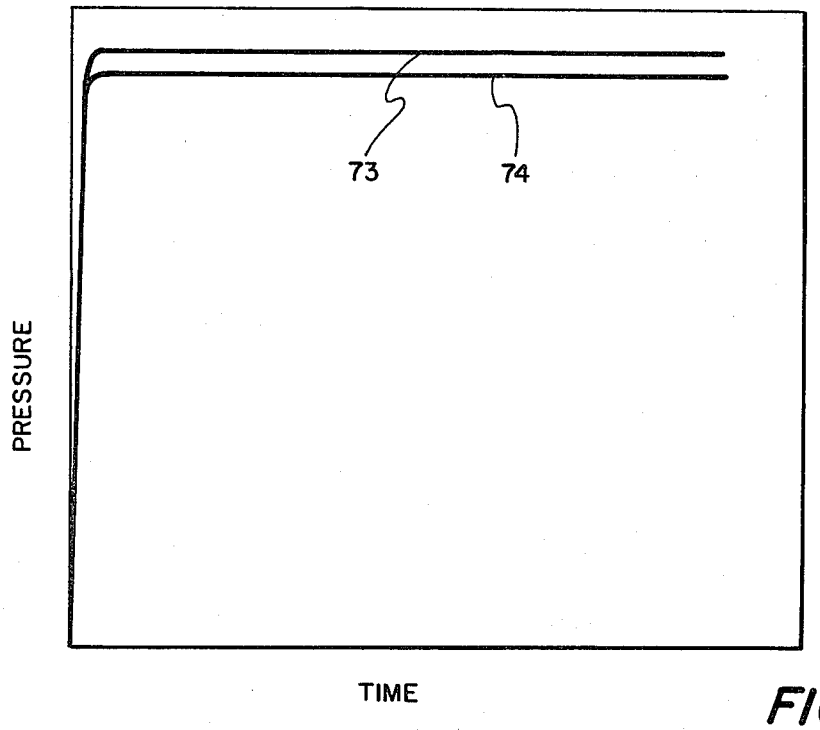
FIGS. 6 and 7 are generalized curves showing different combinations of pressure vs time.
Figure 7:
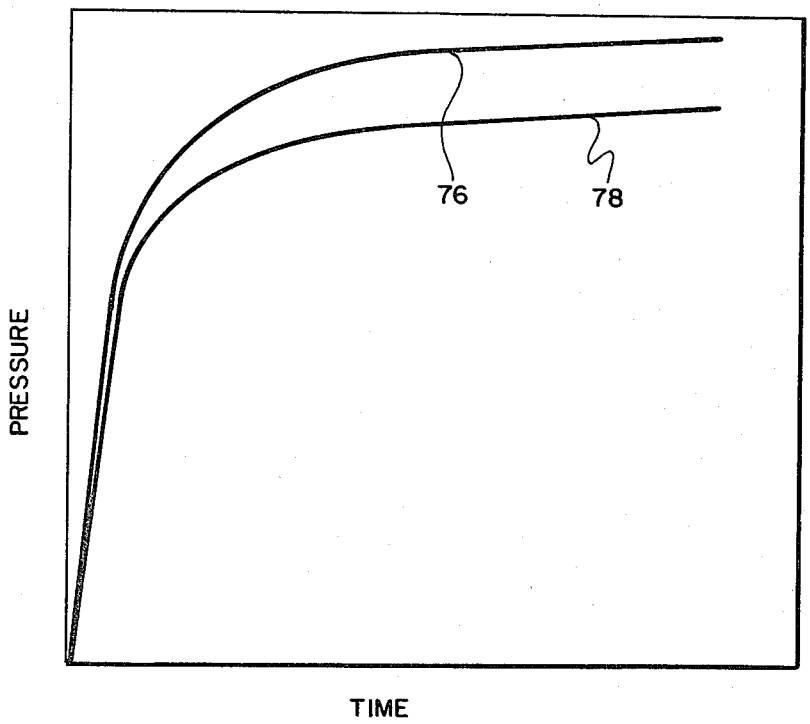

Numerous variations and modifications can be made without departing from the present invention. For example, parts can be compression formed under conventional plastic conditions or under superplastic conditions such as described in U.S. Pat. No. 4,181,000. As shown in FIG. 1, back pressure 8 can be held constant while forward pressure 6 is profiled in order to provide optimum forming of the sheet against the die forming surface. Depending upon the shape of the part being formed and upon the equipment available, it may be preferred to hold the back and forward pressures constant after the forming pressure has been reached (FIG. 6, curves 73, 74), or to increase them continuously (FIG. 7, curves 76, 78), or to vary the back and forward pressure to provide a desired forming rate and to reduce localized thinning and internal microcracking and fracture.

Compression forming can be combined with other processes such as diffusion bonding to make sandwich structures as shown in U.S. Pat. Nos. 3,920,175 and 3,927,817. In some applications liquids rather than gases can be used as the forming fluid. And, of course, a wide variety of alloys, plastics, and other materials can be used provided that the materials exhibit plastic properties under some conditions of temperature and pressure. In fact, the invention is expected to be particularly useful for forming materials which are considered difficult to form into the desired shape using prior art techniques. Accordingly, it should be clearly understood that the form of the invention described above and shown in the accompanying drawings is illustrative only and is not intended to limit the scope of the invention.

What is claimed is:

1. A method of compression forming a sheet of material having plastic properties, comprising:

holding said sheet opposite a surface of a die;

applying fluid pressure concurrently to both sides of said sheet to create a compressive stress in said sheet in the through thickness direction which at least equals the stress at which the material begins to flow plastically;

maintaining said pressure higher on one side of said sheet than on the other side so that said sheet bends toward said surface and forms plastically by said compressive stress against the said surface of said die.

2. The method as claimed in claim 1, including the steps of:

reducing said pressure; and removing said sheet from said die.

3. The method as claimed in claim 1, including the step of heating said sheet to reduce the stress at which the material begins to flow plastically.

4. A method of compression forming a sheet of material having plastic properties, comprising:

holding said sheet opposite a surface of a die;

concurrently applying a fluid back pressure on a side of said sheet which faces said surface and a fluid forward pressure on an opposite side of said sheet to create a compressive stress in said sheet in the through thickness direction which at least equals the stress at which the material begins to flow plastically; and maintaining said forward pressure higher than said back pressure so that said sheet bends toward said surface and forms plastically by said compressive stress against said surface of said die.

5. The method as claimed in claim 4 wherein said back and forward pressures are raised together to create said compressive stress and then said back pressure is held substantially constant while said forward pressure is raised to a higher pressure and held substantially constant to provide said step of maintaining said forward pressure higher than said back pressure.

6. The method as claimed in claim 4, wherein said back and forward pressures are both increased continuously until said sheet is formed against said surface of said die while maintaining said forward pressure higher than said back pressure.

7. The method as claimed in claim 4 wherein said back and forward pressures are raised together to create said compressive stress and then said forward pressure is raised to a higher pressure and its pressure is profiled to provide optimum forming of said sheet against said surface of said die.

8. The method as claimed in claim 4, wherein said back and forward pressures are varied to increase forming rate as required and to reduce localized thinning and internal fracture.

9. A method of compression forming a multilayer structure, comprising:

bonding at least two sheets of material having plastic properties together at predetermined locations;

placing said sheets in a die between an upper die portion and a lower die portion;

concurrently applying fluid pressure to both sides of each of said sheets to create a compressive stress in each of said sheets in the through thickness direction, which stress at least equals the stress at which the material begins to flow plastically; and maintaining said pressure lower against the sides of said sheet which face said upper and lower die portions than against the other sides of said sheets, whereby the unbonded portions of said sheets separate and said sheets expand plastically by said compressive stress into said upper and lower die portions to form the multilayer structure.

10. The method as claimed in claim 9 including the steps of:

reducing said pressure; and removing said multilayer structure from said die.

11. The method as claimed in claim 9 including the step of heating said sheets to reduce the stress at which the material begins to flow plastically.

12. The method as claimed in claim 9, wherein said bonding is accomplished while said at least two sheets are in said die.

* * * * *